US008713888B2

(12) United States Patent
Glenn

(10) Patent No.: US 8,713,888 B2
(45) Date of Patent: May 6, 2014

(54) VERTICAL NAILER FOR A ROOF PANEL STRUCTURE

(76) Inventor: Joseph K. Glenn, Orting, WA (US)

( * ) Notice: Subject to any disclaimer, the term of this patent is extended or adjusted under 35 U.S.C. 154(b) by 137 days.

(21) Appl. No.: 12/496,449

(22) Filed: Jul. 1, 2009

(65) Prior Publication Data

US 2011/0000165 A1 Jan. 6, 2011

(51) Int. Cl.
*E04C 3/02* (2006.01)
*E04C 3/00* (2006.01)
*E04H 12/00* (2006.01)

(52) U.S. Cl.
USPC ..... 52/697; 52/702; 52/92.1; 52/638; 52/643; 52/692; 52/637; 52/648.1

(58) Field of Classification Search
USPC ..... 52/92.2, 90.1, 90.2, 92.1, 93.1, 93.2, 52/702, 289, 694, 695, 697, 364, 638, 643, 52/696, 633, 690, 691, 692, 637, 634, 636, 52/647, 648.1
See application file for complete search history.

(56) References Cited

U.S. PATENT DOCUMENTS

| | | | | |
|---|---|---|---|---|
| 1,706,945 | A | | 3/1929 | White |
| 1,711,163 | A | | 4/1929 | Zabriskie |
| 1,737,601 | A | | 12/1929 | Macomber |
| 1,879,295 | A | | 9/1932 | Kahn |
| 1,951,811 | A | | 3/1934 | Schaffert |
| 2,062,399 | A | | 12/1936 | Coddington |
| 2,112,480 | A | | 3/1938 | Coddington |
| 2,129,625 | A | | 9/1938 | Rafter |
| 2,167,835 | A | | 8/1939 | Greulich |
| 2,167,836 | A | | 8/1939 | Greulich |
| 2,348,703 | A | * | 5/1944 | Weir et al. ..... 428/121 |
| 2,387,432 | A | | 10/1945 | Du Laney |
| 3,131,791 | A | * | 5/1964 | Nichols et al. ..... 52/364 |
| 3,785,109 | A | * | 1/1974 | Letourneur ..... 52/633 |
| 3,882,653 | A | * | 5/1975 | Ollman ..... 52/694 |
| 4,015,396 | A | * | 4/1977 | Butts et al. ..... 52/690 |
| 4,133,155 | A | | 1/1979 | Oelrich |
| 4,156,999 | A | | 6/1979 | Avery |
| 4,159,604 | A | | 7/1979 | Burrell |
| 4,498,801 | A | * | 2/1985 | Gilb ..... 403/232.1 |
| 4,569,501 | A | * | 2/1986 | McCracken ..... 249/209 |
| 4,920,725 | A | * | 5/1990 | Gore ..... 52/702 |
| 5,564,248 | A | * | 10/1996 | Callies ..... 52/702 |
| 6,076,320 | A | | 6/2000 | Butler |
| 6,463,711 | B1 | * | 10/2002 | Callies ..... 52/702 |
| 6,742,245 | B2 | | 6/2004 | Glenn |
| 6,986,204 | B2 | | 1/2006 | Glenn |
| 7,334,372 | B2 | * | 2/2008 | Evans et al. ..... 52/289 |

FOREIGN PATENT DOCUMENTS

DE 44 19 165 A1 2/1995

* cited by examiner

*Primary Examiner* — Chi Q Nguyen
(74) *Attorney, Agent, or Firm* — Kilpatrick Townsend & Stockton LLP

(57) ABSTRACT

A roof panel structure having a purlin comprising a truss, the truss having a substantially horizontally disposed top surface. A nailer board is attached to the top surface, and a first subpurlin is attached to the nailer board and is extends at least partly along the top surface such that the first subpurlin is arranged to be supported by the top surface. The nailer board is arranged vertically on the top surface.

11 Claims, 3 Drawing Sheets

VERTICAL NAILER FOR A ROOF PANEL STRUCTURE

BACKGROUND

Roofs for contemporary buildings, particularly light industrial buildings having rectangular-shaped roofing, are typically formed from roof panel structures that are attached to main supporting beams. Completed roof panel structures may be 25 to 80 feet in length or even longer, and are often lifted to and placed on the main supporting beams by a crane or forklift. Once in place, the roof panel structures are attached, for example by nails, to the main supporting beams and adjacent roof panel structures. A plurality of the roof panel structures together form the roof.

An example of a prior art roof panel structure is generally designated as "A" in FIG. 1. The roof panel structure A includes a major horizontal beam, often called a purlin P. The purlin P in FIG. 1 is a solid structure, such as a glulam beam, a wooden beam, or the like. More recently, as described with reference to FIG. 2, below, the purlin P may include a steel truss, typically including wood or another material along a top edge that permits easy attachment of other components of the roof panel structure (e.g., by nailing).

Minor beams, called "subpurlins" (S in FIG. 2) extend orthogonally to the purlin P, and are often attached to the purlin P by right angle brackets B that extend from an end of the subpurlin. The subpurlins S may be made of any of the materials described above with respect to purlins P, but are typically lumber stiffeners of dimensional lumber, such as 2-by-6's, 2-by-4's, 3-by-4's, 3-by-6's, and so forth, six to ten feet in length.

Diaphragms D, such as wood structural panels (e.g., 4 by 8 feet, 4 by 10 feet, 8 by 8 feet, or 8 by 10 feet structural wood panels) are mounted over the subpurlins S and the purlin P, and are typically nailed to the subpurlins and the purlin for structural and shear support. In the embodiment shown in FIG. 1, the diaphragms D extend beyond both ends of the subpurlins S, and a front end of each of the diaphragms overlaps approximately one half of the thickness of the purlin P. The back ends of the diaphragms D rest on an adjacent purlin P in an adjacent roof panel structure A. Thus, diaphragms for two adjacent roof panel structures A are arranged end to end, with their adjoining surfaces centered over the purlin P.

Subpurlins S are located such that the edges of the diaphragm D overlap one half of the subpurlins that extend along the side edges of the diaphragm, and other, intermediate subpurlins (two shown in FIG. 1, but this number may be varied) are spaced between the two subpurlins on the side edges. Adjacent diaphragms D overlap the other half of the subpurlins S at the side edges.

A single roof panel structure A typically includes a purlin P and the subpurlins S and diaphragms D attached along only one side of the purlin. The number of diaphragms D and subpurlins S used in a roof panel structure A depends upon the spacing of the subpurlins, the width of the diaphragms, and the length of the roof panel structure. Typically, the diaphragms are 4 or 8 feet in width (although they may be less or more wide), and the subpurlins are spaced 24 inches on center (i.e., two edge subpurlins S and one intermediate for a 4 foot wide diaphragm, and two edge subpurlins and three intermediate subpurlins for a 8 foot wide diaphragm, and so forth). Completed roof panel structures A may be 25 to 80 feet in length, or even longer. When installed, these roof panel structures A extend orthogonally to main supporting beams (not shown, but known in the art) and are attached to the main supporting beams and adjacent roof panel structures by nailing or another appropriate attachment method. The distal edges of the subpurlins and diaphragms for one roof panel structure are attached the purlin of an adjacent roof panel structure so that a continuous roof surface is formed. An example method for assembling roof panel structures is described in U.S. Pat. No. 6,986,204, entitled "Method of Constructing Panelized Roof Structures."

As stated above, traditionally, purlins P were formed of solid wood beams or glulam beams. More recently, however, purlins include a steel or other metal truss. Such a structure is lighter, less expensive, and easier to handle than a roof panel structure having a solid beam. An end view of an example of a roof panel structure having a truss purlin P with subpurlins S attached thereto is shown in FIG. 2.

In FIG. 2, the purlin P includes a truss T extending its length. A pair of angled brackets A are attached to a top surface of the truss T. A nailer board N is attached to the top of the angle brackets A.

To attach subpurlins S to the purlin P, the subpurlins are arranged so that the brackets B overhang the nailer board N. The brackets B are then nailed to the nailer board N. The ends of the subpurlins S are supported by the attachment of the brackets B to the nailer board N.

Typically, the nailer board N is a conventional lumber stiffener, such as a 2-by-6, 3×6 or 1¾" lvl nailer. The nailer board N is preferably at least as wide as the combined angle brackets A, with minimal overlap beyond the angle brackets. Often, truss purlins P are provided to an installer that are of inconsistent width, requiring that the installer vary the width of the nailer boards used in an installation. This variation can slow construction. It can be understood that if a nailer board N as shown in FIG. 2 is a 2-by-6, then the dimension between the two subpurlins S is the standard for a 6 inch nominal board, or 5½ inches. In contrast, if a 2-by-8 is provided for the nailer board, then that 2-by-8, 3×8 etc., will separate the two subpurlins by 7¼ inches. This variation in dimension requires that an installer cut the lengths of the subpurlins S to create a consistent spacing between purlins P. The custom fitting of the subpurlins S to the width of the nailer boards N is time consuming and expensive.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with an embodiment, a roof panel structure is provided, having a purlin comprising a truss, the truss having a substantially horizontally disposed top surface. A nailer board is attached to the top surface, and a first subpurlin is attached to the nailer board and is extends at least partly along the top surface such that the first subpurlin is arranged to be supported by the top surface.

The nailer board may define a width and depth, with the width being greater than the depth, and the nailer board may be arranged on the top surface so that the width of the nailer board is arranged orthogonal to the top surface.

In an embodiment, the height of the first subpurlin is substantially equal to the height of the nailer board.

In an embodiment, the first subpurlin and the nailer board are dimensional lumber with the longest of the width and depth for each of the subpurlin and the nailer board being arranged vertically and having the same dimension.

In an embodiment, a roof panel structure is provided, having a purlin comprising a truss, the truss having a top surface, a nailer board attached to the top surface, the nailer board comprising a width and depth, the width being greater than the depth, the nailer board being arranged on the top surface so that the width of the nailer board is arranged orthogonal to the top surface; and a first subpurlin attached to the nailer board.

For a fuller understanding of the nature and advantages of the present invention, reference should be made to the ensuing detailed description and accompanying drawings.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
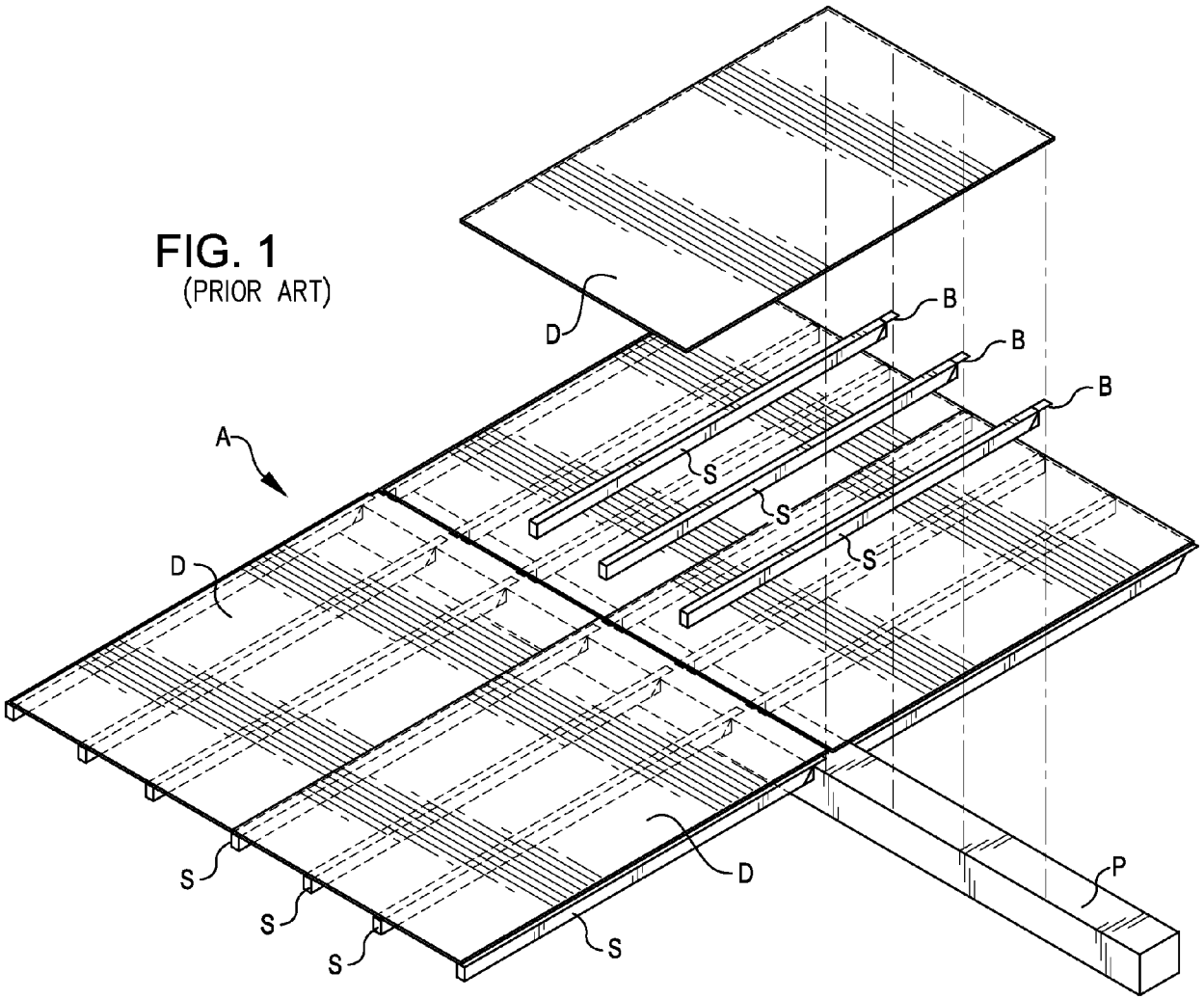
FIG. 1 (PRIOR ART)
FIG. 1 is an exploded perspective view of a prior art roof panel structure.
Figure 3:
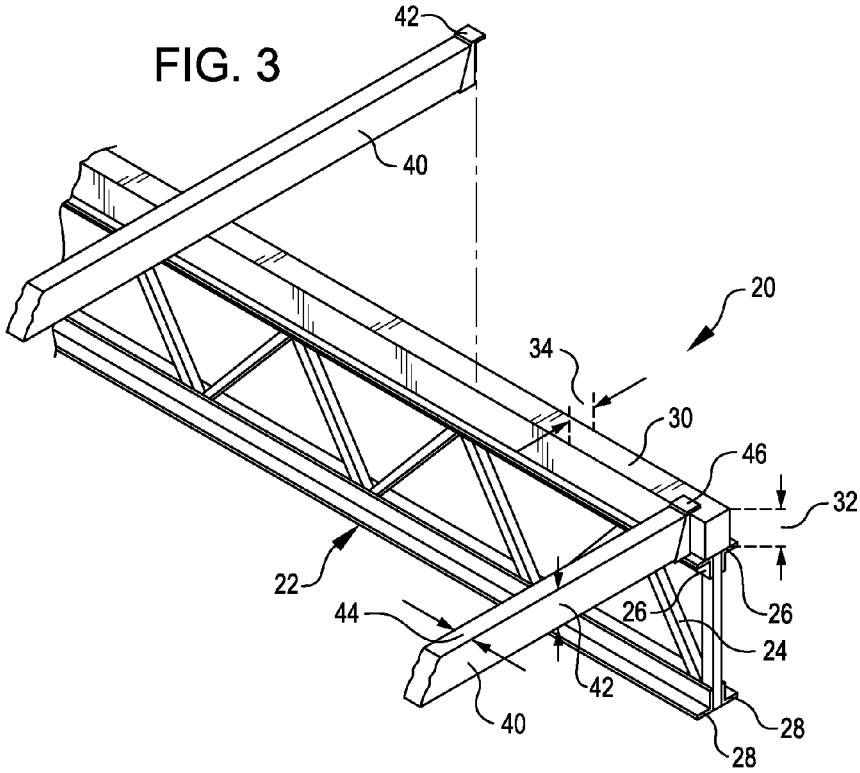
FIG. 3 is an exploded perspective view of a roof panel structure in accordance with an embodiment.

Referring now to the drawings, in which like reference numerals represent like parts throughout the several views, FIG. 3 shows a perspective view of a portion of a roof panel structure 20 in accordance with an embodiment. In the drawings, to aid in the visualization of embodiments, the diaphragms for the roof panel structure 20 are not shown, but would may be included in the roof panel structure, and may be, for example, similar to the diaphragms D shown and described with respect to FIG. 1.

The roof panel structure 20 includes a truss purlin 22. In the embodiment shown in the drawings, the purlin 22 includes a truss 24 extending between pairs of angle brackets 26, 28. In accordance with embodiments, a variety of different structures may be used for the purlin 22, but features described herein are particularly advantageous for a purlin having a truss, such as the truss 24.

The top angle brackets 26 are right angle brackets that extend the length of the truss 24 and are attached at a top edge of the truss so that flanges of the angle brackets extend outward and form a top surface of the truss. The top surface formed by the flanges of the angle brackets 26 extends substantially horizontally during use. The angle brackets 28 may be similarly arranged along the bottom of the truss 24, but their function and arrangement are not relevant to embodiments herein.

Figure 2:
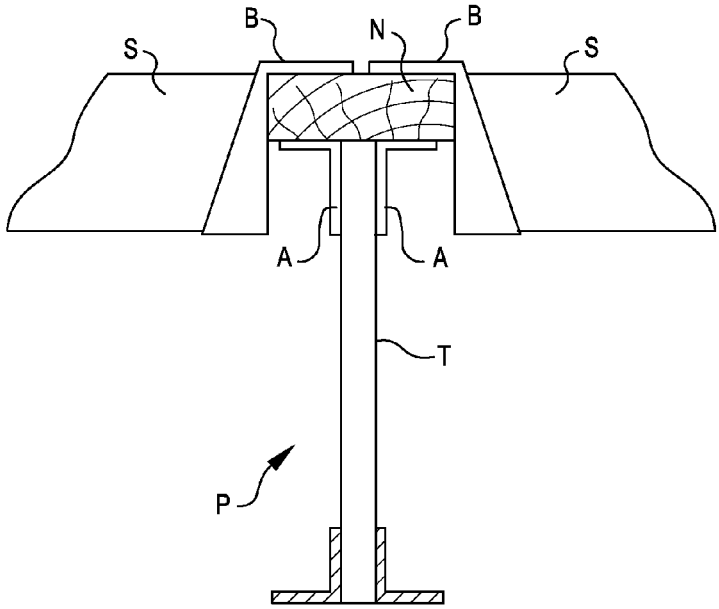
FIG. 2 (PRIOR ART)
FIG. 2 is a diagrammatic representation of an end view of a prior art roof panel structure.

Trusses, such as the truss 24, are readily available for purchase in the construction market, and may include the angle brackets 26 or another top attachment structure. Although described as having angle brackets 26 at the top, the subpurlin may have any type of structure that serves as a horizontally-disposed top surface. In general, when the roof panel structure is installed, the truss is arranged vertically as shown in FIG. 2, and the top surface is utilized for the attachment of subpurlins, as is described below. Angle brackets, such as the angle brackets 26, are typically utilized at the top edges of trusses, such as the truss 24, but other structures may be used that provide a horizontally disposed top surface of the truss.

As described above with reference to FIG. 2, prior art truss purlins in roof panel structures include a nailer board N attached to the top of the truss purlin, such as to the angle brackets 26. The nailer board N in prior art roof panel structures is arranged horizontally; that is, the height of the nailer board is less than the width of the board when the roof panel structure is installed. In addition, prior art nailer boards, such as the nailer board N completely cover the top surface of the angles brackets 26, as shown in FIG. 2.

Figure 4:
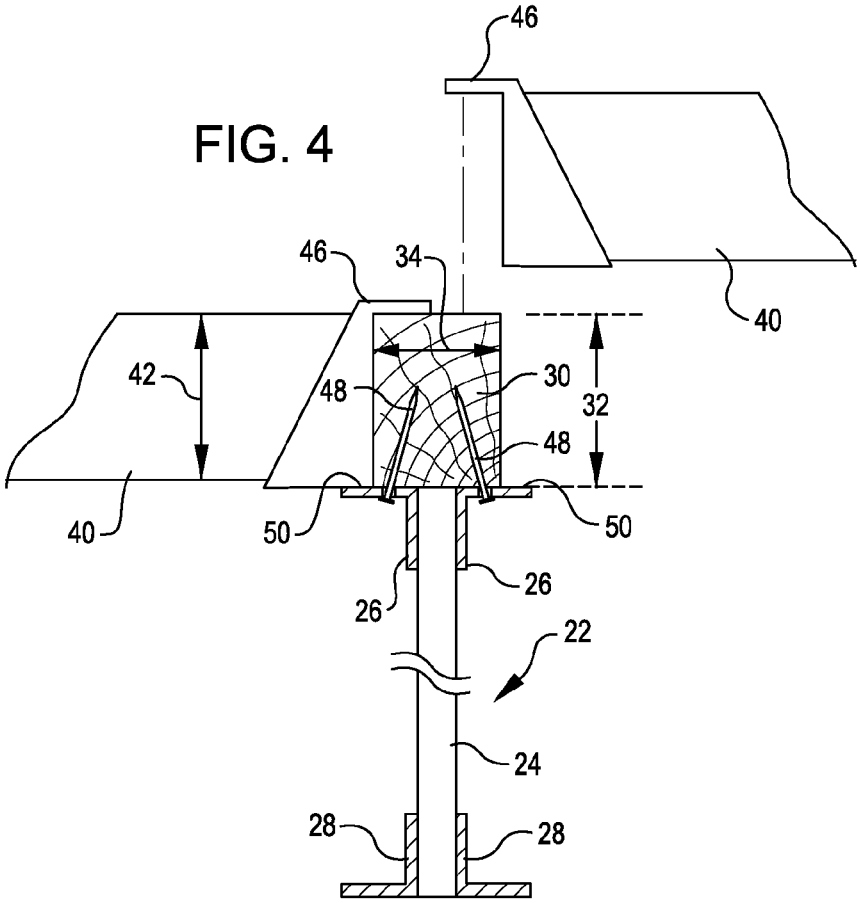
FIG. 4 is an end view of the roof panel structure of FIG. 3.

In accordance with an embodiment, as shown in FIG. 4, a nailer board 30 is provided that is attached to the top surface of the angle brackets 26 and that has a vertical height that is greater than its horizontal width. In an embodiment, the nailer board is dimensional lumber; that is, lumber that is finished/planed and cut to standardized width and depth specified in inches. Common examples of dimensional lumber are 2-by-4s, 4-by-4s, 4-by-6s, 2-by-6s, and so forth. The use of dimensional lumber is advantageous in that it does not require stripping, ripping or planing after it is purchased. An installer may have to cut the dimensional lumber to length, but such cuts involve only a cross-cut, and typically less labor than stripping or planing. Although dimensional lumber is described for use as the nailer board 30 in embodiments herein, other non-standardized lumber may be used.

The nailer board 30 includes a width 32 and a depth 34. For conventional dimensional lumber, the width 32 is greater than or equal to the depth 34, so this arrangement is utilized in descriptions herein. In the embodiment shown, the width 32 is arranged so that it extends vertically, whereas prior art nailer boards have the width arranged horizontally. Moreover, as is best shown in FIG. 4, the nailer board 30 does not cover the entire horizontally-disposed top surface of the angle brackets 26. Instead, it covers a portion of the angle brackets 26, leaving exposed outer edges 50 of the angle brackets.

Subpurlins 40 are attached to the purlin 22, at the nailer board 30. The subpurlins 40 include a width 42 and a depth 44. As is conventional, the subpurlins are arranged so that the width extends in a vertical direction, providing a stiffening function for the diaphragms (not shown, as described above). In the embodiment shown in FIGS. 3 and 4, the subpurlins 40 include hanger brackets 46 attached to ends of the subpurlins 40. These hanger brackets 46 are conventional, such as the brackets B described with reference to FIG. 1, and are used to aid in connecting the purlin 22 to the subpurlins 40, and in supporting the subpurlins and diaphragms when the roof panel structure 20 is installed.

To assemble the roof panel structure 20, an installer obtains the truss 24 and the nailer board 30. The nailer board 30 is attached to the top angle brackets 26, for example via nails (screws etc.), 48 (FIG. 4). As described above, in accordance with an embodiment, the nailer board 30 is arranged vertically; i.e., with the longer, width dimension arranged vertically. Although this arrangement is preferred, the nailer board may be square, such as a 4-by-4, or may be arranged in a different manner.

In accordance with an embodiment, the nailer board 30 is arranged so that it does not completely cover the top surface provided by the angle brackets 26, so that the exposed outer edges are provided. This feature may be provided with or without the vertical arrangement of the nailer board 30, but there are synergistic reasons to provide both features in a single embodiment.

After the nailer board 30 has been installed on the purlin 22, subpurlins 40 may be attached to the subpurlin via the nailer board 30. An embodiment, as shown in FIG. 4, a subpurlin 40 is arranged so that an end is adjacent to the nailer board 30 and the hanger bracket 46 extends over the top of the nailer board. In addition, in accordance with an embodiment, a bottom edge of the subpurlin 40 is supported by the exposed outer edges 50 of the angle brackets 26.

For simultaneous engagement of (1) the hanger bracket 46 and the top of the nailer board 30, and (2) the bottom of the subpurlin 40 and the exposed outer edge 50 of the angle bracket 26, the vertical height of the subpurlin 40 and the nailer board 30 are the same. For the subpurlin 40 and the nailer board 30 to have the same height, in an embodiment where the nailer board and the subpurlin are both arranged vertically, the width 42 of the subpurlin 40 is the same as the width 32 of the nailer board 30. This relationship is shown in FIG. 4. This arrangement allows simultaneous engagement of (1) the hanger bracket 46 and the top of the nailer board 30, and (2) bottom edge of the subpurlin 40 and the exposed outer edge 50 of the angle bracket 26. The additional support provided by outer edges 50 enables a ledger effect, in which the subpurlin 40 is provided additional support, and unlike prior art roof panel structures, the subpurlin and diaphragms are not exclusively supported by the hanger bracket 46. Thus, the subpurlin 40 is more securely supported, eliminating any issues with failure of the hanger bracket 46 and/or providing support for the roof panel structure 20.

Having the vertical height of the subpurlin 40 and the nailer board 30 be the same height, with both supported by the angle brackets 26 also permits the top surfaces of the subpurlin 40 and the nailer board 30 to be coplanar. This feature provides an ideal arrangement for attachment of diaphragms.

In accordance with an embodiment, to ensure that the height of the nailer board 30 is the same as the height of the subpurlin 40, dimensional lumber may be selected for the subpurlin and the nailer board and the height dimensions of the nailer board and the purlin may be matched. For example, if the nailer board 30 is a 4-by-6, with the 6 inch nominal width arranged vertically, then the subpurlin 40 may be, for example, a 2-by-6, with the width 42 being the nominal width of 6 inches. As is known, for dimensional lumber, the actual dimensions are less than the nominal dimensions. For example, a typical 2-by-6 is actually 1½ inches by 5½ inches in actual dimensions. However, the sizes tend to be standardized, and thus selecting matching nominal dimensions for the height of the subpurlin 40 and the nailer board 30, the subpurlin and nailer board should be substantially the same height. This feature allows standard, off-the-shelf dimensional lumber to be utilized for the subpurlin 40 and the nailer board 30, without planing, ripping, or stripping required. As another example, the nailer board 30 may be a 4-by-4, with the subpurlin 40 being a 2-by-4.

An alternate arrangement would allow 6-by-4 dimensional lumber to be used for the nailer board 30 with a 2-by-4 used for the subpurlin 40. In this arrangement, the nailer board 30 would be arranged in a horizontal manner, with the depth 34 arranged vertically so that that depth 34 may match the width 42 of the subpurlin 40. In addition, if desired, a subpurlin 40 may have matching width and depth dimensions. In any event, the subpurlin 40 and the nailer board 30 are preferably arranged so they match in height.

The outer edges 50 provide advantages as set forth above, and these advantages are available whether or not the height of the subpurlin 40 matches the height of the nailer board 30. However, by providing matching heights of the two and the ledger effect provided by outer edges 50, the top edges of the subpurlin 40 and the nailer board 30 match, providing a planar surface to which diaphragms may be attached. In addition, if the hanger bracket 46 is utilized, then two possible attachment and support locations are provided for the subpurlin 40. A first is the overlapping connection provided by the hanger bracket 46, and a second is the ledger effect provided by outer edges 50.

Figure 5:
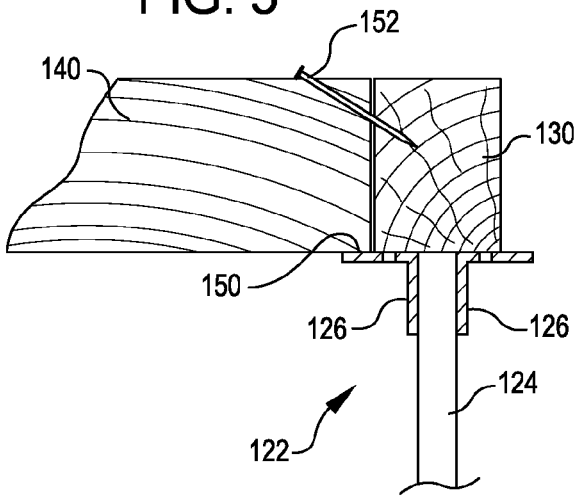
FIG. 5 is an end view, similar to FIG. 4, of an alternate embodiment of a roof panel structure.

The ledger effect provided by the exposed outer edges 50 provides another advantage. As can be seen in the embodiment shown in FIG. 5, a purlin 122 having a truss 124 and angle brackets 126 similar to the purlin 122 described above may include a nailer board 130 and subpurlin 140 similar to the nailer board 30 and the subpurlin 40 described with the embodiment in FIG. 4. However, in this embodiment, the hanger bracket 46 is not used. This option is available because of the ledger effect provided by outer edges 50. That is, the hanger bracket 46 and the support provided by the hanger bracket may not be needed due to the ledger effect provided by outer edges 50 (in FIG. 5, the outer edges 150).

In an embodiment, the ledger effect may be provided without the subpurlin 40 and the nailer board 30 being the same height. Moreover, if the top surface of the purlin 22 is varied, a subpurlin 40 may be used with a nailer board 30 having a different height, but the two may still have coplanar top surfaces. For example, the top surface of the purlin 22 may including an indentation, or seat, into which the nailer board 30 is placed. The exposed outer edges 50 of such an embodiment are thus higher than the bottom edge of the nailer board, allowing the subpurlins 40 to be supported by the top surface, and even though the subpurlins are shorter than the nailer board, the top surfaces of the two are coplanar. An opposite arrangement may also be provided, where the nailer board is mounted to a higher location than the exposed outer edges 50, allowing the subpurlin to be taller than the nailer board. Even though such surfaces are uneven, they are substantially horizontally disposed and capable of supporting the subpurlin and the nailer board.

Alternatives are available. For example, the nailer board 30 may be a structure that is integrated into the joist 24 or may be attached to the top surface using a structure other than the angle brackets 26.

In addition, in accordance with embodiments, the nailer board 30 may be wood or any other structure that allows attachment to the subpurlin. In addition, although called a "nailer board," the subpurlin 40 may be attached to the nailer board 30 by screws or other fasteners, or another suitable attachment function.

Another advantage provided by the vertically arranged nailer board 30 is that use of the nailer board in this manner standardizes the width of nailer boards used in a roof panel structure, such as the roof panel structure 20. As described in the background section of this document, very often the horizontal aligned nailer boards are selected to match the width of the top surface of the purlin. Thus, variation between different trusses may occur, requiring cutting of subpurlins to offset variations in width of the nailer boards. Utilizing the vertical arrangement of the nailer board 30, variations in the top surface of the purlin 22 vary only the dimension of outer edges 50. Thus, less assembly time is required in an installation.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A roof panel structure, comprising:

a purlin comprising a truss elongated in a truss length direction, the truss having a substantially horizontally disposed top surface having a top surface depth in a top surface depth direction perpendicular to the truss length direction;

a nailer board attached to the top surface, the attached nailer board having a nailer board depth in the top surface depth direction, the nailer board depth being less than the top surface depth and opposed outer portions of the top surface being disposed adjacent to the attached nailer board; and a first subpurlin attached to the nailer board and extending over an underlying region of one of the opposed outer portions of the top surface such that the first subpurlin is supported from below by the underlying region.

2. The roof panel structure of claim 1, wherein:

the attached nailer board has a nailer board width perpendicular to the top surface, the nailer board width being greater than the nailer board depth.

3. The roof panel structure of claim 2, wherein the attached first subpurlin has a first subpurlin width perpendicular to the top surface, and wherein the first subpurlin width is substantially equal to the nailer board width.

4. The roof panel structure of claim 3, wherein the first subpurlin and the nailer board are dimensional lumber with the greatest dimension from the width and depth for each of the subpurlin and the nailer board being arranged vertically and having the same dimension.

5. The roof panel structure of claim 1, wherein the attached first subpurlin has a first subpurlin width perpendicular to the top surface, and wherein the first subpurlin width is substantially equal to the nailer board depth.

6. The roof panel structure of claim 5, wherein the first subpurlin and the nailer board are dimensional lumber with the greatest dimension from the width and depth for each of the first subpurlin and the nailer board being arranged vertically and having the same dimension.

7. The roof panel structure of claim 1, wherein the first subpurlin extends substantially orthogonal to the purlin.

8. The roof panel structure of claim 7, further comprising a second subpurlin attached to the nailer board on a side opposite the first subpurlin and extending over an underlying second region of one of the opposed outer portions of the top surface such that the second subpurlin is supported from below by the underlying second region.

9. The roof panel structure of claim 8, wherein the first subpurlin, the second subpurlin, and the nailer board are dimensional lumber with the greatest dimension from the width and depth for each of the first subpurlin, the second subpurlin, and the nailer board being arranged vertically and having the same dimension.

10. The roof panel structure of claim 1, comprising angle brackets attached to the top of the truss and providing the top surface.

11. A roof panel structure, comprising:

a purlin comprising a truss elongated in a truss length direction, the truss comprising top angle brackets defining a substantially horizontally disposed top surface having a top surface depth in a top surface depth direction perpendicular to the truss length direction;

a nailer board attached to the top surface, the attached nailer board having a nailer board depth in the top surface depth direction and a nailer board width perpendicular to the top surface, the nailer board width being greater than the-nailer board depth, the nailer board depth being less than the top surface depth and opposed outer portions of the top surface being disposed adjacent to the attached nailer board; and a subpurlin attached to the nailer board and extending over an underlying region of one of the opposed outer portions of the top surface such that the subpurlin is supported from below by the underlying region.

* * * * *